US010002566B2

(12) United States Patent
Park et al.

(10) Patent No.: US 10,002,566 B2
(45) Date of Patent: Jun. 19, 2018

(54) ORGANIC LIGHT EMITTING DISPLAY DEVICE AND METHOD OF DRIVING THE SAME

(71) Applicant: SAMSUNG DISPLAY CO., LTD., Yongin-si, Gyeonggi-do (KR)

(72) Inventors: Sung Un Park, Yongin-si (KR); Hyung Min Shin, Yongin-si (KR); Kyung Ho Hwang, Yongin-si (KR)

(73) Assignee: Samsung Display Co., Ltd., Yongin-si, Gyeonggi-do (KR)

( * ) Notice: Subject to any disclaimer, the term of this patent is extended or adjusted under 35 U.S.C. 154(b) by 118 days.

(21) Appl. No.: 15/241,217

(22) Filed: Aug. 19, 2016

(65) Prior Publication Data

US 2017/0103707 A1 Apr. 13, 2017

(30) Foreign Application Priority Data

Oct. 13, 2015 (KR) ..... 10-2015-0142969

(51) Int. Cl.
*G09G 3/3258* (2016.01)
*G09G 3/20* (2006.01)

(52) U.S. Cl.
CPC ..... *G09G 3/3258* (2013.01); *G09G 3/2003* (2013.01); *G09G 2310/08* (2013.01); *G09G 2320/0295* (2013.01); *G09G 2320/0673* (2013.01); *G09G 2330/028* (2013.01)

(58) Field of Classification Search
CPC ..... G09G 3/3258; G09G 3/2003; G09G 2320/0295; G09G 2330/028; G09G 2320/0673; G09G 2310/08
See application file for complete search history.

(56) References Cited

U.S. PATENT DOCUMENTS

| | | | | |
|---|---|---|---|---|
| 8,890,779 | B2 | 11/2014 | Lee et al. | |
| 9,129,556 | B2 | 9/2015 | Park | |
| 2013/0257924 | A1* | 10/2013 | Hirashima | G09G 5/02 345/690 |

FOREIGN PATENT DOCUMENTS

| | | | |
|---|---|---|---|
| KR | 10-2011-0091974 | A | 8/2011 |
| KR | 10-1064370 | B1 | 9/2011 |
| KR | 10-1310376 | B1 | 9/2013 |
| KR | 10-2014-0120421 | A | 10/2014 |

* cited by examiner

*Primary Examiner* — Charles Hicks
(74) *Attorney, Agent, or Firm* — Lee & Morse, P.C.

(57) ABSTRACT

An organic light emitting display device includes pixel unit, a power supply, and a timing controller. The power supply supplies a driving voltage to the pixel unit. The timing controller divides the pixel unit into a plurality of regions, calculates color on-pixel ratio (C-OPR) values of the regions based on image data, and controls the power supply based on the C-OPR values of the regions.

20 Claims, 7 Drawing Sheets

FIG. 7

| Maximum C-OPR | Secondary C-OPR | DRIVING VOLTAGE [V] (ex.ELVSS) |
|---|---|---|
| 230<C-OPR≦255 | 230<C-OPR≦255 | -4.5 |
| | 200<C-OPR≦230 | -4.4 |
| | 0≦C-OPR≦200 | -4.3 |
| 200<C-OPR≦230 | 200<C-OPR≦230 | -4.3 |
| | 170<C-OPR≦200 | -4.2 |
| | 0≦C-OPR≦170 | -4.1 |
| ⋮ | ⋮ | ⋮ |

ORGANIC LIGHT EMITTING DISPLAY DEVICE AND METHOD OF DRIVING THE SAME

CROSS-REFERENCE TO RELATED APPLICATION

Korean Patent Application No. 10-2015-0142969, filed on Oct. 13, 2015, and entitled: "Organic Light Emitting Display Device and Method of Driving the Same," is incorporated by reference herein in its entirety.

BACKGROUND

1. Field

One or more embodiments described herein relate to an organic light emitting display device and a method for driving an organic light emitting display device.

2. Description of the Related Art

An organic light emitting display device generates an image using organic light emitting diodes. This type of display device is thinner and has lower power consumption than other types of display. As a result, organic light emitting display devices are widely used in various electronic devices including a portable terminal such as a smart phone.

SUMMARY

In accordance with one or more embodiments, an organic light emitting display device includes a pixel unit including a plurality of pixels; a power supply to supply a driving voltage to the pixel unit; and a timing controller to control the power supply, wherein the timing controller is to divide the pixel unit into a plurality of regions, calculate respective color on-pixel ratio (C-OPR) values of the regions based on image data, and control the power supply based on the respective C-OPR values of the regions.

The timing controller may include a C-OPR calculator to calculate the respective C-OPR values of the regions; a driving voltage selector to compare the respective C-OPR values of the regions and to select a value of the driving voltage based on at least a maximum C-OPR value among the C-OPR values of the regions; and a voltage control signal generator to generate a voltage control signal corresponding to the selected value of the driving voltage.

The C-OPR calculator may operate the image data of the respective regions together with characteristic values of color light emitting materials and gamma values to calculate the respective C-OPR values of the regions. The C-OPR calculator may calculate the respective C-OPR values of the regions based on the following Equation 1:

$$C-OPR=\frac{\sum_{n=1}^{T}\left\{Rc\left(\frac{Rn}{255}\right)^{\gamma}\right\}}{T}+\frac{\sum_{n=1}^{T}\left\{Gc\left(\frac{Gn}{255}\right)^{\gamma}\right\}}{T}+\frac{\sum_{n=1}^{T}\left\{Bc\left(\frac{Bn}{255}\right)^{\gamma}\right\}}{T}$$

where Rc, Gc, and Bc respectively represent relative ratios of driving currents that flow through red, green, and blue subpixels of a unit pixel that emits white light, Rn, Gn, and Bn respectively represent image data of the red, green, and blue subpixels in each region, γ represents a gamma value applied to a panel, and T represents a resolution of each region. The C-OPR calculator may calculate a final C-OPR value based on a brightness control ratio in addition to the C-OPR value of Equation 1.

The timing controller may include a first storage area to store the respective C-OPR values of the regions. The driving voltage selector may select the value of the driving voltage based on the maximum C-OPR value among the C-OPR values of the respective regions and at least one of C-OPR values of remaining regions. The timing controller may include a second storage area to store the value of the driving voltage in accordance with at least the maximum C-OPR value. The timing controller may include a third storage area to store information on the voltage control signal corresponding to the selected value of the driving voltage.

The power supply may output the driving voltage having a value corresponding to a voltage control signal input from the timing controller. The driving voltage may include a high potential power source voltage and a low potential power source voltage, and the power supply may control and output a value of the low potential power source voltage based on the voltage control signal.

In accordance with one or more other embodiments, a method for driving an organic light emitting display device includes dividing a pixel unit into a plurality of regions; receiving image data for the divided regions; calculating respective color on-pixel ratio (C-OPR) values for the regions based on the image data of the regions; comparing the respective C-OPR values of the regions and selecting a value of a driving voltage based on a result of the comparison; generating a voltage control signal corresponding to the value of the driving voltage; generating the driving voltage having the voltage value corresponding to the voltage control signal; and supplying the driving voltage to the pixel unit.

Dividing the pixel unit into the plurality of regions may include dividing the pixel unit into the plurality of regions based on a degree of voltage drop of the driving voltage generated in the pixel unit.

Calculating the respective C-OPR values of the regions based on the image data of the regions may include operating the image data of the regions together with characteristic values of color light emitting materials and gamma values to calculate the respective C-OPR values of the regions.

Calculating the respective C-OPR values of the regions based on the image data of the regions may include calculating a final C-OPR value additionally based on a brightness control ratio corresponding to a brightness change register value that is to entirely control brightness of the pixel unit.

Comparing the respective C-OPR values of the regions and selecting the value of the driving voltage based on the comparison result may include selecting a maximum C-OPR value among the respective C-OPR values of the regions and selecting the value of the driving voltage based on at least the maximum C-OPR value.

Comparing the respective C-OPR values of the regions and selecting the value of the driving voltage based on the comparison result may include selecting at least one of C-OPR values of remaining regions excluding the maximum C-OPR value as a secondary C-OPR value, wherein the value of the driving voltage is selected based on the maximum C-OPR value and the secondary C-OPR value.

In accordance with one or more other embodiments, a controller includes a calculator to calculate color on-pixel ratio (C-OPR) values of different regions of a display device based on image data; and logic to control a power supply of the display device based on the C-OPR values of the regions of the display device. The calculator may include a C-OPR calculator to calculate the C-OPR values of the regions; a driving voltage selector to compare the C-OPR values and to select a value of a driving voltage based on at least a maximum C-OPR value among the C-OPR values; and a signal generator to generate a voltage control signal corresponding to the selected value of the driving voltage. The C-OPR calculator may operate the image data of the regions together with characteristic values of color light emitting materials and gamma values to calculate the C-OPR values of the regions.

BRIEF DESCRIPTION OF THE DRAWINGS

Features will become apparent to those of skill in the art by describing in detail exemplary embodiments with reference to the attached drawings in which:

FIG. 7 illustrates an example of a table of on-pixel ratios and driving voltages.

DETAILED DESCRIPTION

Figure 1:
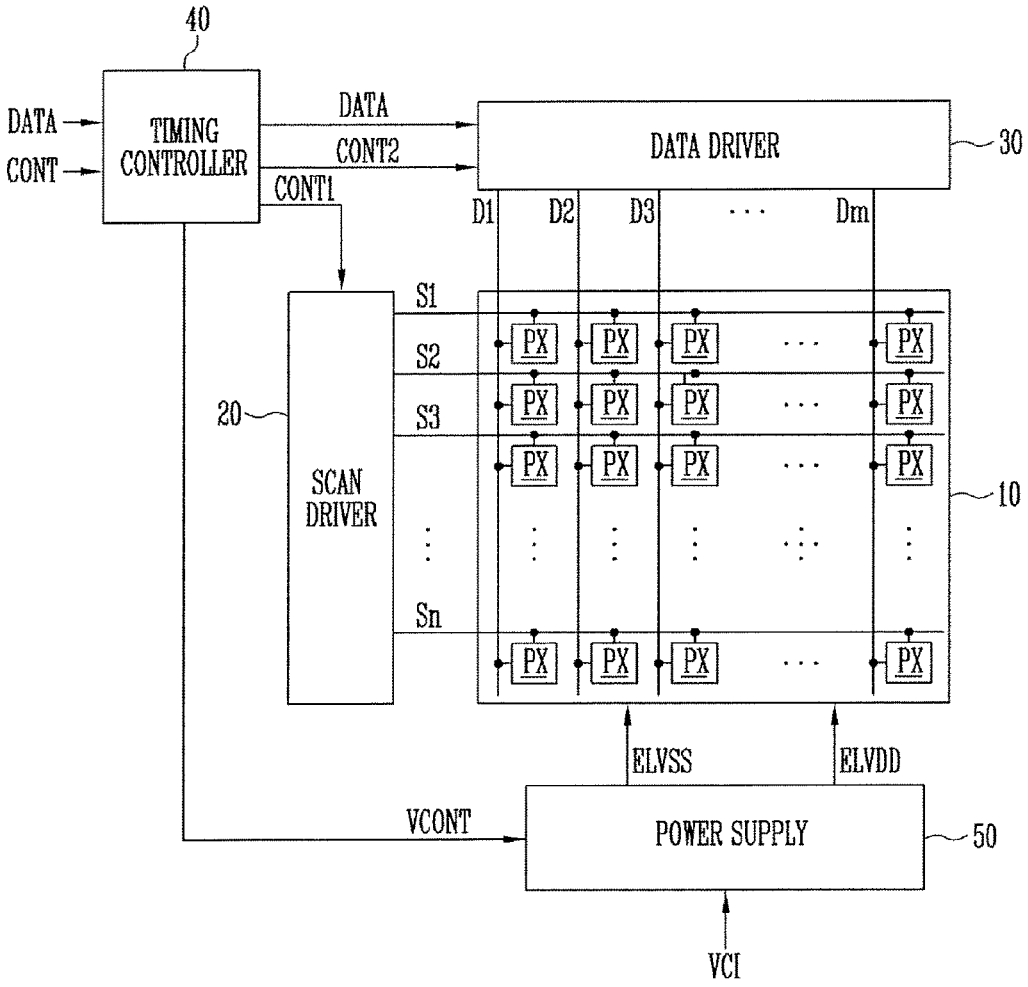
FIG. 1 illustrates an embodiment of an organic light emitting display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of an organic light emitting display device which includes a pixel unit 10, a scan driver 20, a data driver 30, a timing controller 40, and a power supply 50.

The pixel unit 10 includes a plurality of pixels PX connected to scan lines S1 to Sn and data lines D1 to Dm. When scan signals are supplied from the scan lines in corresponding horizontal lines, the pixels PX receive data signals from data lines of corresponding vertical lines and emit light with a brightness corresponding to the data signals.

The scan driver 20 generates scan signals in response to a first control signal CONT1 from the timing controller 40. The scan signals are supplied to the scan lines S1 to Sn.

The data driver 30 generates data signals in response to image data DATA and a second control signal CONT2 from the timing controller 40. The data signals are supplied to the data lines D1 to Dm.

The timing controller 40 realigns the image data DATA (e.g., input from an external source) and supplies the realigned image data DATA to the data driver 30. For example, the timing controller 40 realigns the digital image data DATA based on a predetermined resolution. The realigned digital image data DATA is then transmitted to the data driver 30.

In addition, the timing controller 40 generates the first control signal CONT1 and the second control signal CONT2 based on a control signal CONT (e.g., input from an external source) and respectively supplies the first control signal CONT1 and the second control signal CONT2 to the scan driver 20 and the data driver 30.

The control signal CONT input to the timing controller 40 may include vertical and horizontal synchronizing signals and an input clock signal. The first control signal CONT1 output from the timing controller 40 to the scan driver 20 may include a gate start pulse, a gate clock, and a gate output enable signal. The second control signal CONT2 output from the timing controller 40 to the data driver 30 may include a source shift clock, a source start pulse, and a source output enable signal.

According to one embodiment, the timing controller 40 generates a voltage control signal VCONT corresponding to the image data DATA and controls the power supply 50 based on the voltage control signal VCONT. For example, the timing controller 40 divides the pixel unit 10 into a plurality of regions, calculates color on-pixel ratio (C-OPR) values of the respective regions based on the image data DATA, and generates the voltage control signal VCONT corresponding to the calculated C-OPR values of the respective regions.

In one embodiment, the timing controller 40 divides the pixel unit 10 into the plurality of regions in accordance with degrees of voltage drops of driving voltages and operates the image data DATA of the respective regions together with panel characteristic values that affect actual current consumption of a panel to calculate the C-OPR values of the respective regions. The timing controller 40 generates the voltage control signal VCONT for controlling the power supply 50 in accordance with the calculated C-OPR values of the respective regions, so that margins of the driving voltages are reduced or minimized.

The power supply 50 supplies the driving voltages to the pixel unit 10. For example, the power supply 50 generates a high potential power source voltage ELVDD and a low potential power source voltage ELVSS based on an input power source VCI, and supplies the high potential power source voltage ELVDD and the low potential power source voltage ELVSS to the pixel unit 10.

According to one embodiment, the power supply 50 controls an output level of at least one driving voltage ELVDD and ELVSS in response to the voltage control signal VCONT from the timing controller 40. For example, the power supply 50 generates the low potential power source voltage ELVSS having a value corresponding to the voltage control signal VCONT and supplies the low potential power source voltage ELVSS to the pixel unit 10.

Figure 2:
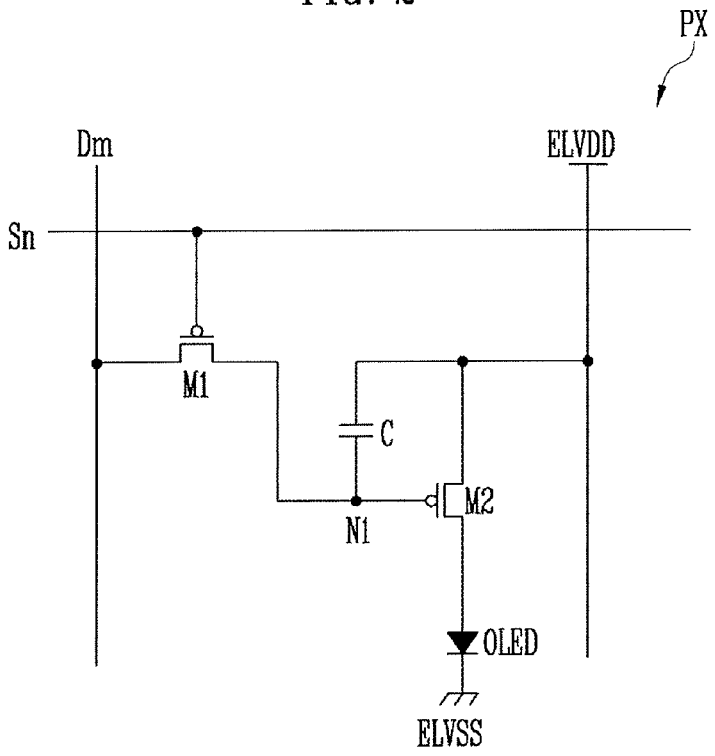
FIG. 2 illustrates an embodiment of a pixel.

FIG. 2 illustrates an embodiment of a pixel PX, which, for example, may be representative of the pixels in the display device of FIG. 1. For convenience sake, in FIG. 2, the pixel PX is illustrated as being connected to the nth scan line Sn and the mth data line Dm.

Referring to FIG. 2, the pixel PX includes an organic light emitting diode (OLED), first and second transistors M1 and M2, and a storage capacitor C. The OLED has a first electrode (e.g., anode electrode) connected to an input line of the high potential power source voltage ELVDD via the second transistor M2 and a second electrode (e.g., cathode electrode) connected to an input line of the low potential power source voltage ELVSS. The OLED in each pixel PX may include, for example, a light emitting layer (e.g., a red light emitting layer, a green light emitting layer, or a blue light emitting layer) to emit a predetermined color of light. The OLED emits light with brightness corresponding to a driving current supplied through the second transistor M2.

The first transistor (e.g., a switching transistor) M1 is connected between the data line Dm and a first node N1. The gate electrode of the first transistor M1 is connected to the scan line Sn. The first transistor M1 is turned on when the scan signal is supplied from the scan line Sn to transmit the data signal from the data line Dm to the first node N1.

The storage capacitor C is connected between the first node N1 and the input line of the high potential power source voltage ELVDD. The storage capacitor C stores a voltage corresponding to the data signal transmitted to the first node N1 and maintains the stored voltage until a data signal of a next frame is transmitted to the first node N1.

The second transistor (e.g., a driving transistor) M2 is connected between the input line of the high potential power source voltage ELVDD and the OLED. The gate electrode of the second transistor M2 is connected to the first node N1. The second transistor M2 controls the amount of driving current that flows through the OLED based on the voltage of the first node N1, that is, a voltage corresponding to the data signal.

Thus, the OLED emits light with a brightness corresponding to the data signal. When a data signal corresponding to a black grayscale value is supplied, the second transistor M2 does not supply driving current to the OLED. Therefore, the OLED does not emit light. The pixel PX may receive a data signal in each frame and may emit light with brightness based on the data signal to display a corresponding grayscale value.

Figure 3:
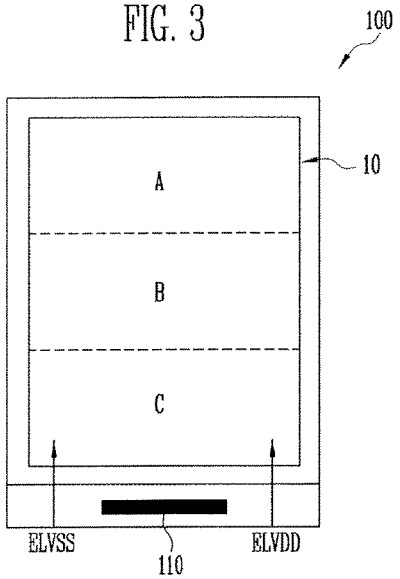
FIG. 3 illustrates an embodiment of a panel.
Figure 4:
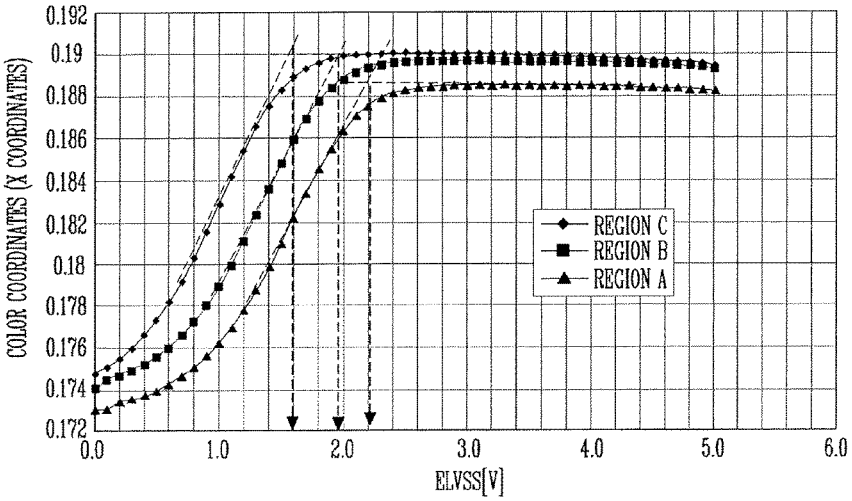
FIG. 4 illustrates an example of how color coordinates in accordance with the driving voltage in different regions of the panel.

FIG. 3 illustrates an example of a panel 100, which, for example, may be included in the display device of FIG. 1. FIG. 4 is a graph illustrating an example of changes in color coordinates in accordance with driving voltage in regions A, B, and C in FIG. 3.

Referring to FIG. 3, the panel 100 includes at least the pixel unit 10 and may further include a driving circuit 110 according to an embodiment. For example, the driving circuit 110 may be integrated with at least one of the scan driver 20 or the data driver 30. The panel 100 receives driving voltages (e.g., high potential power source voltage ELVDD and the low potential power source voltage ELVSS) from the power supply 50 and is driven.

The power supply 50 may be mounted on a circuit substrate, for example, outside the panel 100, and may supply the driving voltages ELVDD and ELVSS to the pixel unit 10 through a part (for example, a lower part) of the panel 100.

When the driving voltages ELVDD and ELVSS are supplied from a partial region of the panel 100, and in the process of transmitting the driving voltages ELVDD and ELVSS to the pixels PX, a deviation in the driving voltages ELVDD and ELVSS actually applied to the respective regions of the pixel unit 10 may occur as a result of a voltage drop caused by resistance of a power source wiring line.

For example, the pixels PX in region A in the upper part of the panel 100 may receive driving voltages ELVDD and ELVSS having a relatively large voltage drop. In contrast, the pixels PX in region C in the lower part of panel 100 may receive driving voltages ELVDD and ELVSS having a relatively small voltage drop. In addition, the pixels PX in region B in an intermediate part of the panel 100 may receive driving voltages ELVDD and ELVSS having an intermediate value of voltage drop relative to that in regions A and C. Therefore, operation points of the driving transistors (e.g., the second transistors M2 in the pixels PX) may be different in respective regions of the pixel unit 10.

For example, as illustrated in FIG. 4, when changes in color coordinates (X coordinates) of the respective regions in accordance with the low potential power source voltage ELVSS are measured, minimum values of the low potential power source voltage ELVSS for obtaining stable color coordinates are different in the respective regions. In FIG. 4, it is assumed that the low potential power source voltage ELVSS is a positive polar voltage. However, the value of the low potential power source voltage ELVSS may change or be different in another embodiment. For example, the low potential power source voltage ELVSS may be a negative polar voltage.

Therefore, in order to stably drive the pixels PX in the entire region of the display panel 100, the value of the low potential power source voltage ELVSS may be set, for example, to be suitable for region A in the upper part of the display panel 100 in which the voltage drop is largest.

For example, after setting the low potential power source voltage ELVSS based on an evaluation result based on region B in the intermediate part, an offset value (e.g., 0.2V to 0.3V) that may satisfy the value of the low potential power source voltage ELVSS required for stably driving the pixels PX in region A is added to set the low potential power source voltage ELVSS.

When the low potential power source voltage ELVSS is set based on region A in which the voltage drop is largest, a larger margin is added to the low potential power source voltage ELVSS in regions B and C than in region A. In addition, when the driving voltages ELVDD and ELVSS are collectively set for all images that may be displayed on the pixel unit 10, driving voltages ELVDD and ELVSS may be set based on when an image with large power consumption, for example, full-white is displayed.

However, the driving voltages ELVDD and ELVSS are fixed based on a maximum light emitting amount of the pixel unit 10. Thus, when an image with a small light emitting amount is displayed, the pixel unit 10 is driven by driving voltages ELVDD and ELVSS to which unnecessarily large margins are added.

Therefore, when the driving voltages ELVDD and ELVSS are set and collectively applied in an attempt to achieve stable picture quality in the entire region of the pixel unit 10 regardless of an actually displayed image, there are limitations on reducing power consumption.

In accordance with the present embodiment, the pixel unit 10 is divided into a plurality of regions based on degrees of voltage drops of the driving voltages ELVDD and ELVSS. Also, C-OPR values that reflect current that actually flows through the panel 100 are calculated based on the image data DATA of corresponding frames of the respective regions. The C-OPR values of the respective regions are compared with each other and the value of at least one driving voltage ELVDD or ELVSS (for example, the low potential power source voltage ELVSS) is controlled to be suitable for the C-OPR value of a region in which the maximum (or other predetermined) current consumption is to occur.

In addition, according to one embodiment, the C-OPR value is calculated in consideration of characteristic values that affect current consumption of the panel 100, such as characteristic values of light emitting materials of the respective colors and gamma values. The value of the at least one driving voltage ELVDD or ELVSS is controlled based on the calculated C-OPR value. Therefore, it is possible to reduce or minimize unnecessary voltage margin and thus to prevent deterioration of picture quality and to effectively reduce power consumption.

Figure 5:
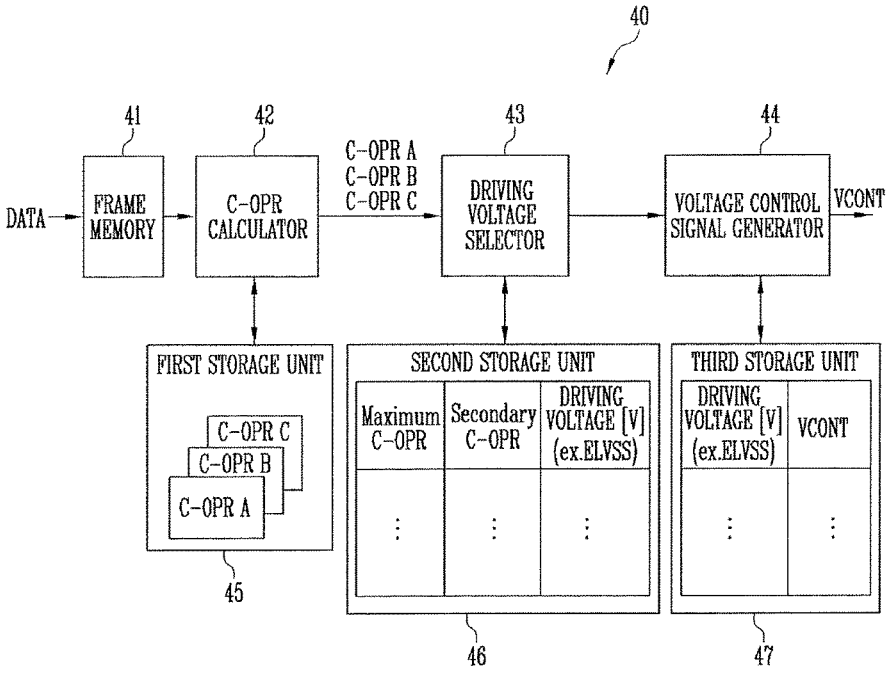
FIG. 5 illustrates an embodiment of a timing controller.
Figure 6:
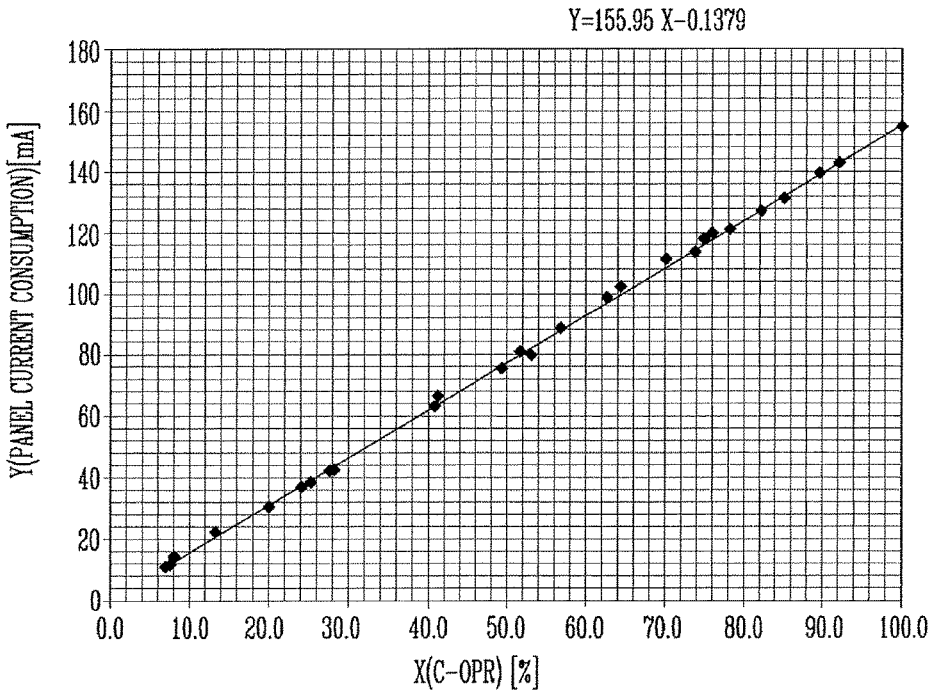
FIG. 6 illustrates an example of color on-pixel ratio and current consumption.

FIG. 5 illustrates an embodiment of a timing controller, which, for example, may correspond to the timing controller 40 in FIG. 1. In FIG. 5 a driving voltage control block for the timing controller may be included in the timing controller or coupled to the timing controller. For example, in this latter case, the driving voltage control block may be a separate driving voltage controller. In addition, in FIG. 5, the low potential power source voltage ELVSS is controlled. However, in another embodiment, the one or more other power source voltages may be controlled. FIG. 6 is a graph illustrating an example of the correlation between a color on-pixel ratio (C-OPR) value and current consumption of the panel.

Referring to FIG. 5, the timing controller 40 includes a frame memory 41, a C-OPR calculator 42, a driving voltage selector 43, a voltage control signal generator 44, and first to third storage units 45, 46, and 47. The frame memory 41 stores the image data DATA of each frame, which, for example, may be received from an external source.

The C-OPR calculator 42 divides the image data DATA of each frame into regions and calculates the C-OPR values of the respective regions. For example, as illustrated in FIG. 3, the C-OPR calculator 42 may divide the pixel unit 10 into three regions A, B, and C and may divide the image data DATA of each frame in respect to the regions to calculate the C-OPR values C-OPR A of the region A, the C-OPR value C-OPR B of the region B, and the C-OPR value C-OPR C of the region C.

In one embodiment, the C-OPR value is an average value for calculating current that actually flows through the panel 100, for example, based on the image data DATA of each frame and the characteristic values of the panel 100. In one embodiment, the C-OPR values C-OPR A, C-OPR B, and C-OPR C of the respective regions may be calculated based on Equation 1.

$$C-OPR=\frac{\sum_{n=1}^{T}\left\{Rc\left(\frac{Rn}{255}\right)^{\gamma}\right\}}{T}+\frac{\sum_{n=1}^{T}\left\{Gc\left(\frac{Gn}{255}\right)^{\gamma}\right\}}{T}+\frac{\sum_{n=1}^{T}\left\{Bc\left(\frac{Bn}{255}\right)^{\gamma}\right\}}{T} \quad (1)$$

In Equation 1, Rc, Gc, and Bc respectively represent relative ratios of driving currents that flow through red, green, and blue pixels when a unit pixel formed of red, green, and blue subpixels emits white light. In one embodiment, Rc, Gc, and Bc may correspond to the characteristic values of the light emitting materials of the respective color subpixels.

For example, when the red, green, and blue subpixels that form one unit pixel are turned on with a maximum grayscale value to display white light, the amounts of driving currents that flow through the red, green, and blue subpixels are not necessarily set to be the same. Relative ratios of the driving currents that flow through the subpixels of the respective colors may be different, for example, in accordance with light emitting efficiencies of light emitting materials of the respective colors.

In one example, the relative ratios of the driving currents that flow through the red, green, and blue subpixels of the unit pixel that displays white light may not be simply set as 1:1:1, but rather may be, for example, 0.63:0.79:1.58. The relative ratios of the driving currents of the red, green, and blue subpixels may vary in accordance with the light emitting materials. For example, Rc, Gc, and Bc in Equation 1 may vary in accordance with materials that form the subpixels. Equation 1 includes a current calculating algorithm by color.

In addition, in Equation 1, Rn, Gn, and Bn are image data (e.g., grayscale data) for the red, green, and blue subpixels, respectively, of a corresponding frame in each region. For example, in Equation 1, $\gamma$ represents the gamma value applied to the panel 100 and T represents resolution of each region.

Thus, the C-OPR value for calculating the current that flows through the panel 100 using the image data DATA is an average light emitting ratio that totally reflects the characteristic values (for example, characteristic values of the light emitting materials of the respective colors or the gamma values) of the panel 100 that are related to light emission, as well as the image data DATA. When the C-OPR value is calculated, the current that actually flows through the panel 100 may be estimated with high correctness.

For example, as a result of calculating the C-OPR values of the respective regions or the C-OPR value of the entire panel 100 by Equation 1 and matching the C-OPR values or the C-OPR value to a measured value of the current that flows through the panel 100, values obtained by converting the C-OPR values into percentage ratios are linearly proportional to the actually measured current consumptions of the panel 100.

When the C-OPR values of the respective regions are calculated in each frame based on Equation 1, it is possible to more correctly calculate current consumptions of the respective regions in consideration of the image data DATA of each frame and the material characteristics of the respective colors. For example, the C-OPR value calculated by Equation 1 includes characteristic values of the panel 100 that affect the current that actually flows through the panel 100 together with the image data DATA.

Therefore, when at least one driving voltage (for example, the low potential power source voltage ELVSS) is controlled based on the C-OPR values of the respective regions, it is possible to reduce or minimize an unnecessary voltage margin to prevent deterioration of picture quality based on the image displayed in each frame, the characteristic values of the panel 100, and voltage drops of the low potential power source voltage ELVSS in the respective regions.

On the other hand, when the panel 100 is designed to entirely control brightness of the pixel unit 10 after manufacturing the organic light emitting display device, a final C-OPR value C-OPR* may be calculated based on the brightness control ratio selected by a manufacturer or a user together with the C-OPR value obtained by Equation 1.

The final C-OPR value C-OPR* may be calculated, for example, based on Equation 2 in consideration of the brightness control ratio.

$$C-OPR^{*} = \left[ \frac{\sum_{n=1}^{T} \left\{ Rc\left(\frac{Rn}{255}\right)^{\gamma} \right\}}{T} + \frac{\sum_{n=1}^{T} \left\{ Gc\left(\frac{Gn}{255}\right)^{\gamma} \right\}}{T} + \frac{\sum_{n=1}^{T} \left\{ Bc\left(\frac{Bn}{255}\right)^{\gamma} \right\}}{T} \right] \times K \tag{2}$$

In Equation 2, K represents the brightness control ratio. For example, in the panel 100 in which the entire brightness may be finely controlled by a brightness control value of 8 bits, the value K may be set as a value obtained by dividing the selected brightness control value of 8 bits (a brightness change register value) by 255.

When the brightness control ratio is additionally considered in the panel 100 in which the brightness may change, the current consumption of the panel 100 may be more correctly estimated.

The C-OPR values C-OPR A, C-OPR B, and C-OPR C of the respective regions calculated by the C-OPR calculator 42 by the above-described method may be stored in the first storage unit 45 and transmitted to the driving voltage selector 43. In one embodiment, the first storage unit 45 may be omitted.

The driving voltage selector 43 compares the C-OPR values C-OPR A, C-OPR B, and C-OPR C of the respective regions calculated by the C-OPR calculator 42 and selects a value of at least one driving voltage (for example, the low potential power source voltage ELVSS) in accordance with the comparison result. For example, the driving voltage selector 43 selects the maximum C-OPR value Maximum C-OPR among the C-OPR values C-OPR A, C-OPR B, and C-OPR C of the respective regions with reference to the second storage unit 46, and may select the value of the low potential power source voltage ELVSS corresponding to at least the maximum C-OPR value Maximum C-OPR.

For this purpose, the second storage unit 46 may store the value of the low potential power source voltage ELVSS corresponding to at least a range of a predetermined C-OPR, e.g., the maximum C-OPR value Maximum C-OPR. In another embodiment in which the value of the high potential power source voltage ELVDD is changed, the second storage unit 46 may store the value of the high potential power source voltage ELVDD corresponding to a range of the predetermined C-OPR, e.g., maximum C-OPR value Maximum C-OPR, of each frame.

When the low potential power source voltage ELVSS is to be more finely changed, the driving voltage selector 43 sets at least one of the C-OPR values of the remaining regions (excluding the maximum C-OPR value Maximum C-OPR) of a corresponding frame as a secondary C-OPR value Secondary C-OPR to be secondarily considered, and may select the value of the low potential power source voltage ELVSS based on the maximum C-OPR value Maximum C-OPR and the secondary C-OPR value Secondary C-OPR.

For example, the driving voltage selector 43 may set the second largest C-OPR value among the C-OPR values C-OPR A, C-OPR B, and C-OPR C of the respective regions as the secondary C-OPR value Secondary C-OPR. In another example, the driving voltage selector 43 may calculate an average value of the C-OPR values of the remaining regions (excluding the maximum C-OPR value Maximum C-OPR) among the C-OPR values C-OPR A, C-OPR B, and C-OPR C of the respective regions and may set the calculated average value as the secondary C-OPR value Secondary C-OPR.

When the value of the low potential power source voltage ELVSS is to be controlled based on the secondary C-OPR value Secondary C-OPR together with the maximum C-OPR value Maximum C-OPR, the second storage unit 46 may store the value of the low potential power source voltage ELVSS corresponding to the range of the maximum C-OPR value Maximum C-OPR, so that the value of the low potential power source voltage ELVSS is differentially subdivided with respect to each range of the maximum C-OPR value Maximum C-OPR in accordance with one or more secondary C-OPR values Secondary C-OPR.

FIG. 7 illustrates an example of a lookup table which may be stored in the second storage unit 46 of FIG. 5. The ranges of the maximum C-OPR value Maximum C-OPR and the secondary C-OPR value Secondary C-OPR, the number of processes of subdividing each range, and the value of the low potential power source voltage ELVSS in accordance with the ranges of the maximum C-OPR value Maximum C-OPR and the secondary C-OPR value Secondary C-OPR, and the number of processes of subdividing each range in the table may be different in different embodiments.

Referring again to FIG. 5, the value of the low potential power source voltage ELVSS selected by the driving voltage selector 43 is transmitted to the voltage control signal generator 44. The voltage control signal generator 44 generates the voltage control signal VCONT corresponding to the value of the low potential power source voltage ELVSS received from the driving voltage selector 43. For example, the voltage control signal generator 44 may generate the voltage control signal VCONT corresponding to the value of the low potential power source voltage ELVSS received from the driving voltage selector 43 with reference to the third storage unit 47.

The third storage unit 47 stores information on the voltage control signal VCONT to be generated in response to the value of the low potential power source voltage ELVSS. For example, the third storage unit 47 may store the number of pulses of the voltage control signal VCONT corresponding to a value of each low potential power source voltage ELVSS that may be selected.

The voltage control signal generator 44 extracts the number of pulses of the voltage control signal VCONT corresponding to the value of the low potential power source voltage ELVSS received from the driving voltage selector 43 from the third storage unit 47, and generates the voltage control signal VCONT having the number of pulses corresponding to the value of the low potential power source voltage ELVSS.

According to an embodiment, the driving voltage selector 43 and the voltage control signal generator 44 in FIG. 5 may be integrated with other. In addition, according to an embodiment, the second storage unit 46 and the third storage unit 47 may be integrated with each other.

The voltage control signal VCONT generated by the voltage control signal generator 44 is transmitted to the power supply 50 in FIG. 1. Then, the power supply 50 generates the low potential power source voltage ELVSS having the value corresponding to the received voltage control signal VCON. The low potential power source voltage ELVSS generated by the power supply 50 is supplied to the pixel unit 10.

In the above-described embodiment, the value of the low potential power source voltage ELVSS may be controlled in response to the C-OPR values of the respective regions. In another embodiment, the value of the high potential power source voltage ELVDD may be controlled or the values of the two driving voltages ELVDD and ELVSS may be controlled in response to the C-OPR values of the respective regions.

Figure 8:
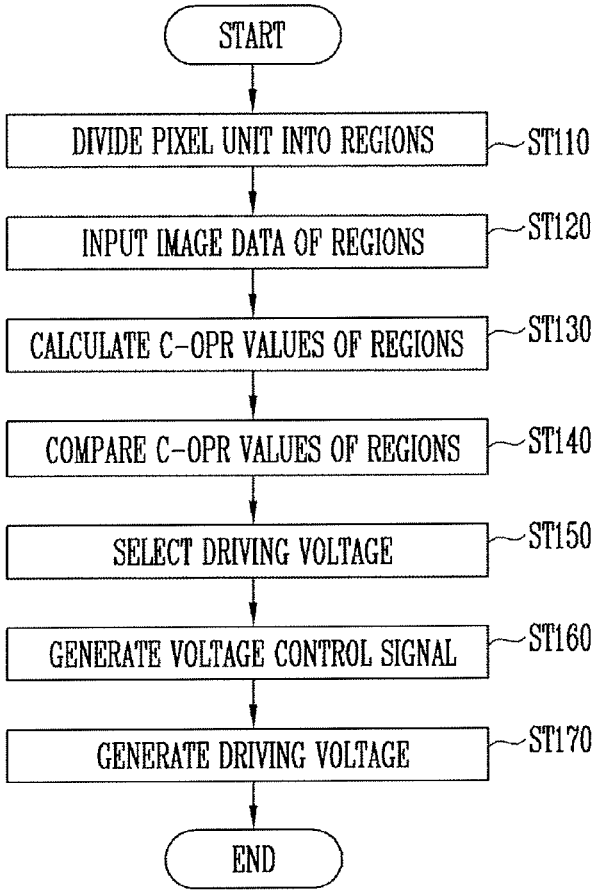
FIG. 8 illustrates an embodiment of a method for driving an organic light emitting display device.

FIG. 8 illustrates an embodiment of a method for driving an organic light emitting display device, which for example may be the display device in FIG. 1.

Region Dividing and Image Data Inputting Operations: ST110 and ST120

According to this method, the timing controller 40 divides the pixel unit 10 into the plurality of regions and receives the image data DATA of the respective regions. For example, the timing controller 40 may divide the pixel unit 10 into the regions A, B, and C based on the degree of voltage drop. For example, when 1,920 horizontal pixel rows exist in the pixel unit 10, the timing controller 40 may group the horizontal pixel rows in the upper part, the intermediate part, and the lower part by 640 and may divide the pixel unit 10 into region A, region B, and region C. The timing controller 40 may receive the image data DATA corresponding to region A, region B, and region C.

Operation of Calculating C-OPR Values of the Respective Regions: ST130

The timing controller 40 calculates the C-OPR values of the respective regions based on the image data DATA of the respective regions and the characteristic values of the panel 100. For example, the timing controller 40 may calculate the C-OPR values of the respective regions based on Equation 1 or 2.

Operation of Comparing C-OPR Values of the Respective Regions: ST140

The timing controller 40 may select at least one predetermined value (e.g., the maximum C-OPR value Maximum C-OPR) after comparing the C-OPR values of the respective regions. For example, the timing controller 40 selects the maximum C-OPR value Maximum C-OPR based on a result of comparing the C-OPR values of the respective regions and selects the secondary C-OPR value Secondary C-OPR corresponding to at least one value among the C-OPR values of the remaining regions.

Driving Voltage Selecting Operation: ST150

The timing controller 40 selects the value of at least one driving voltage ELVDD or ELVSS in accordance with the result of comparing the C-OPR values of the respective regions. For example, the timing controller 40 selects the value of at least one of the high potential power source voltage ELVDD and the low potential power source voltage ELVSS based on the result of comparing the C-OPR values of the respective regions. For example, the timing controller 40 may select and extract the value of the low potential power source voltage ELVSS corresponding to the maximum C-OPR value Maximum C-OPR and the secondary C-OPR value Secondary C-OPR from the lookup table of the second storage unit 46.

Voltage Control Signal Generating Operation: ST160

The timing controller 40 generates the voltage control signal VCONT corresponding to the selected value of at least one driving voltage ELVDD or ELVSS. For example, the timing controller 40 may generate the voltage control signal VCONT corresponding to the selected value of the low potential power source voltage ELVSS. The voltage control signal VCONT generated by the timing controller 40 is transmitted to the power supply 50.

Driving Voltage Generating Operation: ST170

The power supply 50 that receives the voltage control signal VCONT controls and outputs the value of at least one driving voltage ELVDD or ELVSS based on the voltage control signal VCONT. For example, the power supply 50 generates the low potential power source voltage ELVSS having the value corresponding to the voltage control signal VCONT and may output the generated low potential power source voltage ELVSS to the pixel unit 10.

Processes for calculating the C-OPR values of the respective regions based on the image data DATA and for controlling the value of at least one driving voltage ELVDD or ELVSS based on the calculated C-OPR values may be performed in each frame. For example, the margin of the voltage value of at least one driving voltage ELVDD or ELVSS is controlled to be reduced or minimized based on the image displayed in each frame, so that power consumption may be reduced or minimized.

In another embodiment, the maximum C-OPR value is calculated in accordance with the result of comparing the C-OPR values of the respective regions in a plurality of frames. However, the calculated maximum C-OPR value may not be directly used for controlling the value of the low potential power source voltage ELVSS. The average value (or root meat square) of the maximum values of the low potential power source voltage ELVSS calculated in the plurality of frames is calculated and the value of the low potential power source voltage ELVSS may be finally controlled based on the average value. In this case, it is possible to prevent the values of the driving voltages ELVDD and ELVSS from rapidly changing between two continuous frames.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The controllers, calculators, drivers, selectors, signal generators, and other processing features of the embodiments disclosed herein may be implemented in logic which, for example, may include hardware, software, or both. When implemented at least partially in hardware, the controllers, calculators, drivers, selectors, signal generators, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, calculators, drivers, selectors, signal generators, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, battery duration is one of the factors that affects the choice of selecting a display device or a portable terminal by a user. Power consumption affects battery duration. In accordance with one or more of the aforementioned embodiments, a pixel unit is divided into the plurality of regions and at least one driving voltage (e.g., ELVDD or ELVSS) is controlled based on C-OPR values of the respective regions together with the image data DATA of the respective frames.

The C-OPR values reflect the characteristic values of the panel 100 related to light emission as well as the image data DATA. The C-OPR values indicate the value of current actually flowing through the panel 100. Therefore, when the C-OPR values of the respective regions are calculated and the at least one driving voltage ELVDD or ELVSS is controlled using the calculated C-OPR values, it is possible to reduce or minimize the margin of the driving voltage ELVDD or ELVSS, to thereby prevent deterioration of picture quality and maximize the effect of reducing power consumption.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the claims.

What is claimed is:

1. An organic light emitting display device, comprising:

a pixel unit including a plurality of pixels;

a power supply to supply a driving voltage to the pixel unit; and a timing controller to control the power supply, wherein the timing controller is to divide the pixel unit into a plurality of regions, calculate respective color on-pixel ratio (C-OPR) values of the regions based on image data, and control the power supply based on the respective C-OPR values of the regions.

2. The display device as claimed in claim 1, wherein the timing controller includes:

a C-OPR calculator to calculate the respective C-OPR values of the regions;

a driving voltage selector to compare the respective C-OPR values of the regions and to select a value of the driving voltage based on at least a maximum C-OPR value among the C-OPR values of the regions; and a voltage control signal generator to generate a voltage control signal corresponding to the selected value of the driving voltage.

3. The display device as claimed in claim 2, wherein the C-OPR calculator is to operate the image data of the respective regions together with characteristic values of color light emitting materials and gamma values to calculate the respective C-OPR values of the regions.

4. The display device as claimed in claim 2, wherein the C-OPR calculator is to calculate the respective C-OPR values of the regions based on the following Equation 1:

$$C-OPR=\frac{\sum_{n=1}^{T}\left\{Rc\left(\frac{Rn}{255}\right)^{\gamma}\right\}}{T}+\frac{\sum_{n=1}^{T}\left\{Gc\left(\frac{Gn}{255}\right)^{\gamma}\right\}}{T}+\frac{\sum_{n=1}^{T}\left\{Bc\left(\frac{Bn}{255}\right)^{\gamma}\right\}}{T}$$

where Rc, Gc, and Bc respectively represent relative ratios of driving currents that flow through red, green, and blue subpixels of a unit pixel that emits white light, Rn, Gn, and Bn respectively represent image data of the red, green, and blue subpixels in each region, $\gamma$ represents a gamma value applied to a panel, and T represents a resolution of each region.

5. The display device as claimed in claim 4, wherein the C-OPR calculator is to calculate a final C-OPR value based on a brightness control ratio in addition to the C-OPR values of Equation 1.

6. The display device as claimed in claim 2, wherein the timing controller includes a first storage area to store the respective C-OPR values of the regions.

7. The display device as claimed in claim 2, wherein the driving voltage selector is to select the value of the driving voltage based on the maximum C-OPR value among the C-OPR values of the respective regions and at least one of C-OPR values of remaining regions.

8. The display device as claimed in claim 2, wherein the timing controller includes a second storage area to store the value of the driving voltage in accordance with at least the maximum C-OPR value.

9. The display device as claimed in claim 2, wherein the timing controller includes a third storage area to store information on the voltage control signal corresponding to the selected value of the driving voltage.

10. The display device as claimed in claim 1, wherein the power supply is to output the driving voltage having a value corresponding to a voltage control signal input from the timing controller.

11. The display device as claimed in claim 10, wherein:

the driving voltage includes a high potential power source voltage and a low potential power source voltage, and the power supply is to control and output a value of the low potential power source voltage based on the voltage control signal.

12. A method for driving an organic light emitting display device, the method comprising:

dividing a pixel unit into a plurality of regions;

receiving image data for the regions;

calculating respective color on-pixel ratio (C-OPR) values for the regions based on the image data of the regions;

comparing the respective C-OPR values of the regions and selecting a value of a driving voltage based on a result of the comparison;

generating a voltage control signal corresponding to the value of the driving voltage;

generating the driving voltage having the voltage value corresponding to the voltage control signal; and supplying the driving voltage to the pixel unit.

13. The method as claimed in claim 12, wherein dividing the pixel unit into the plurality of regions includes dividing the pixel unit into the plurality of regions based on a degree of voltage drop of the driving voltage generated in the pixel unit.

14. The method as claimed in claim 12, wherein calculating the respective C-OPR values of the regions based on the image data of the regions includes operating the image data of the regions together with characteristic values of color light emitting materials and gamma values to calculate the respective C-OPR values of the regions.

15. The method as claimed in claim 14, wherein calculating the respective C-OPR values of the regions based on the image data of the regions includes calculating a final C-OPR value additionally based on a brightness control ratio corresponding to a brightness change register value that is to entirely control brightness of the pixel unit.

16. The method as claimed in claim 12, wherein comparing the respective C-OPR values of the regions and selecting the value of the driving voltage based on the comparison result includes selecting a maximum C-OPR value among the respective C-OPR values of the regions and selecting the value of the driving voltage based on at least the maximum C-OPR value.

17. The method as claimed in claim 16, wherein comparing the respective C-OPR values of the regions and selecting the value of the driving voltage based on the comparison result includes:

selecting at least one of C-OPR values of remaining regions excluding the maximum C-OPR value as a secondary C-OPR value, wherein the value of the driving voltage is selected based on the maximum C-OPR value and the secondary C-OPR value.

18. A controller, comprising:

a calculator to calculate color on-pixel ratio (C-OPR) values of different regions of a display device based on image data; and logic to control a power supply of the display device based on the C-OPR values of the regions of the display device.

19. The controller as claimed in claim 18, wherein the calculator includes:

a C-OPR calculator to calculate the C-OPR values of the regions;

a driving voltage selector to compare the C-OPR values and to select a value of a driving voltage based on at least a maximum C-OPR value among the C-OPR values; and a signal generator to generate a voltage control signal corresponding to the selected value of the driving voltage.

20. The controller as claimed in claim 19, wherein the C-OPR calculator is to operate the image data of the regions together with characteristic values of color light emitting materials and gamma values to calculate the C-OPR values of the regions.

* * * * *